US008081729B2

(12) United States Patent
Cros

(10) Patent No.: US 8,081,729 B2
(45) Date of Patent: Dec. 20, 2011

(54) HEAT EXCHANGER ASSEMBLY, IN PARTICULAR FOR A HIGH-TEMPERATURE NUCLEAR REACTOR

(75) Inventor: Alain Cros, Courbevoie (FR)

(73) Assignee: Areva NP, Courbevoie (FR)

( * ) Notice: Subject to any disclaimer, the term of this patent is extended or adjusted under 35 U.S.C. 154(b) by 1032 days.

(21) Appl. No.: 11/993,763

(22) PCT Filed: Jun. 22, 2006

(86) PCT No.: PCT/FR2006/001430

§ 371 (c)(1),
(2), (4) Date: Dec. 21, 2007

(87) PCT Pub. No.: WO2007/000507

PCT Pub. Date: Jan. 4, 2007

(65) Prior Publication Data

US 2010/0038062 A1 Feb. 18, 2010

(30) Foreign Application Priority Data

Jun. 27, 2005 (FR) ..... 05 06512

(51) Int. Cl.
*G21C 15/00* (2006.01)

(52) U.S. Cl. ..... 376/404; 376/405; 376/406; 165/157; 165/158; 165/159; 165/160

(58) Field of Classification Search ..... 376/404, 376/405, 406; 165/157–160
See application file for complete search history.

(56) References Cited

U.S. PATENT DOCUMENTS 4,098,329 A 7/1978 Culver et al.

FOREIGN PATENT DOCUMENTS

| | | | |
|---|---|---|---|
| FR | 2 793 875 | A | 11/2000 |
| JP | 2004 144422 | A | 5/2004 |
| WO | WO-95 01834 | A | 1/1995 |

*Primary Examiner* — Ricardo Palabrica

(74) *Attorney, Agent, or Firm* — Connolly Bove Lodge & Hutz LLP

(57) ABSTRACT

The invention relates to an assembly for exchanging heat between first and second fluids, the assembly comprising a central manifold communicating with one of the inlet and the outlet for the first fluid; an annular manifold disposed around the central manifold and communicating with the other one of the inlet and the outlet for the first fluid; a plurality of heat exchangers interposed radially interposed between the central manifold and the annular manifold; and a plurality of axial inlet manifolds communicating with the inlet for the second fluid, and a plurality of axial outlet manifolds communicating with the outlet for the second fluid, the axial inlet and outlet manifolds being interposed circumferentially between the heat exchangers. According to the invention, the assembly has an inlet chamber disposed at a first axial end of the heat exchangers and putting the inlet(s) for the second fluid into communication with at least a plurality of axial inlet manifolds.

25 Claims, 11 Drawing Sheets

HEAT EXCHANGER ASSEMBLY, IN PARTICULAR FOR A HIGH-TEMPERATURE NUCLEAR REACTOR

CROSS REFERENCE TO RELATED APPLICATIONS

This application is a National Phase filing under 35 U.S.C. §371 of PCT/FR2006/001430 filed Jun. 22, 2006, which claims priority to Patent Application No. 0506512, filed in France on Jun. 27, 2005. The entire contents of each of the above-applications are incorporated herein by reference.

The invention relates in general to heat exchangers, in particular for a high temperature or a very high temperature nuclear reactor (HTR or VHTR).

More precisely, the invention relates to a heat exchanger assembly for exchanging heat between a first fluid and a second fluid, the assembly comprising:

- an outer enclosure presenting a central axis and provided with at least one inlet and outlet for the first fluid and with at least one inlet and outlet for the second fluid;
- a central manifold extending along the central axis and communicating with one of the inlet and the outlet for the first fluid;
- an annular manifold disposed around the central manifold and communicating with the other one of the inlet and the outlet for the first fluid;
- a plurality of heat exchangers distributed around the central axis and radially interposed between the central manifold and the annular manifold;
- a plurality of axial inlet manifolds communicating with the inlet for the second fluid, and a plurality of axial outlet manifolds communicating with the outlet for the second fluid, the axial inlet and outlet manifolds being circumferentially interposed between the heat exchangers; and
- each heat exchanger comprises a plurality of channels for flow of the first fluid between the central and annular manifolds, and a plurality of channels for flow of the second fluid from at least one inlet manifold towards at least one outlet manifold.

Assemblies of this type are known from patent document JP-2004/144422 which describes a heat exchanger assembly provided with a respective secondary fluid inlet for each axial inlet manifold. In such an assembly, each inlet is generally connected to the corresponding axial inlet manifold by a welded pipe. In operation, the connection between the pipe and the manifold is subjected to high levels of thermomechanical stress. It therefore presents a risk of premature rupture.

In this context, the invention seeks to propose a heat exchanger assembly in which the risk of such rupture is greatly reduced, both in normal operation, and in an accidental situation.

To this end, the invention provides an assembly of the above-specified type, characterized in that it comprises an inlet chamber provided at a first axial end of the heat exchangers and putting the inlet(s) for the second fluid into communication with at least a plurality of the axial inlet manifolds.

The assembly may also present one or more of the following characteristics considered individually or in any technically feasible combination:

- the inlet chamber is annular in shape and surrounds the central manifold;
- it includes an outlet chamber provided at a second axial end of the heat exchangers opposite from the first axial end and putting the outlet(s) for the second fluid into communication with at least a plurality of axial outlet manifolds;
- it includes an inspection channel extending the central manifold axially from the second end, and isolated therefrom by a removable hatch, the outlet chamber being annular in shape and surrounding the inspection channel;
- at least the heat exchangers, the inlet and outlet chambers, and the axial inlet and outlet manifolds are united in a mechanical subassembly that can be extracted as a single piece from the enclosure;
- the enclosure has a vertical central axis, the enclosure comprising a vessel within which the subassembly is disposed and presenting towards the top an opening for extracting said subassembly, and a removable closure head for closing the opening of the vessel in leaktight manner;
- the vessel comprises a cylindrical shell coaxial with the central axis and having the inlet and outlet for the second fluid formed therein, the inlet and outlet chambers being connected in leaktight manner to the inlet and outlet for the second fluid by removable sleeves that can be retracted into the chambers;
- the sleeves are suitable for being dismounted from inside the chambers;
- the enclosure has a plurality of inlets for the second fluid and a plurality of outlets for the second fluid, these inlets and outlets being brought together in a single circumferential half of the shell;
- the subassembly comprises a cylindrical outer envelope coaxial about the central axis, defining the outlet chamber and the annular manifold radially outwards;
- the assembly includes bottom inlet and outlet manifolds that are coaxial and in communication respectively with the inlet and outlet for the first fluid, and that are disposed beneath the subassembly, the bottom of the subassembly being defined by a frustoconical envelope converging from the cylindrical envelope, said frustoconical envelope surrounding the central manifold and co-operating therewith to define the annular manifold, the bottom manifolds being terminated upwards by flanges suitable for receiving the bottom free ends of the central manifold and of the frustoconical envelope in leaktight manner merely by mutual engagement;
- the central manifold presents an inspection hole that is closed by a removable hatch and that communicates with the inlet chamber, and the inspection channel presents an opening communicating with the outlet chamber;
- the enclosure presents a bottom end wall, and the assembly includes a circulation member fastened to the bottom end wall and suitable for sucking in the first fluid coming from the annular channel or from the central channel and of delivering it to the outlet for the first fluid;
- the axial inlet and outlet manifolds, the central manifold, and the annular manifold, all have through sections that are sufficient to enable an operator to act directly on the heat exchangers;
- the inlet and outlet for the first fluid are coaxial;
- the heat exchangers are disposed regularly spaced apart in a circle around the central axis, each axial manifold being defined both inwards and outwards by respective inner and outer circumferential sheets welded to the two heat exchangers between which said manifolds extend;
- the annular manifold is defined inwardly by the heat exchangers and by the outer sheets;

the central manifold is defined by the heat exchangers and by the inner sheets;

each heat exchanger comprises a plurality of heat exchange modules that are stacked axially;

the modules present, perpendicularly to the central axis, a section that is rectangular, and present corners that are machined over the full axial height of the heat exchanger, the heat exchanger further including forged and/or machined metal bars disposed in the machined corners and onto which the modules are welded; and each bar presents a flange projecting circumferentially relative to the modules and towards the neighboring axial manifold, having the inner or outer sheet defining said axial manifold welded thereto.

In a second aspect, the invention provides the use of an assembly presenting the above-described characteristics:

with a first fluid mainly comprising helium and a second fluid mainly comprising helium and/or nitrogen;

with a first fluid mainly comprising helium and a second fluid mainly comprising water, the second fluid being vaporized in the heat exchanger assembly;

with first and second fluids mainly comprising water, the second fluid being vaporized in the heat exchanger assembly; and with one of the first and second fluids coming from a nuclear reactor.

Other characteristics and advantages of the invention appear from the following description given by way of non-limiting indication and with reference to the accompanying figures, in which.

Figure 1:
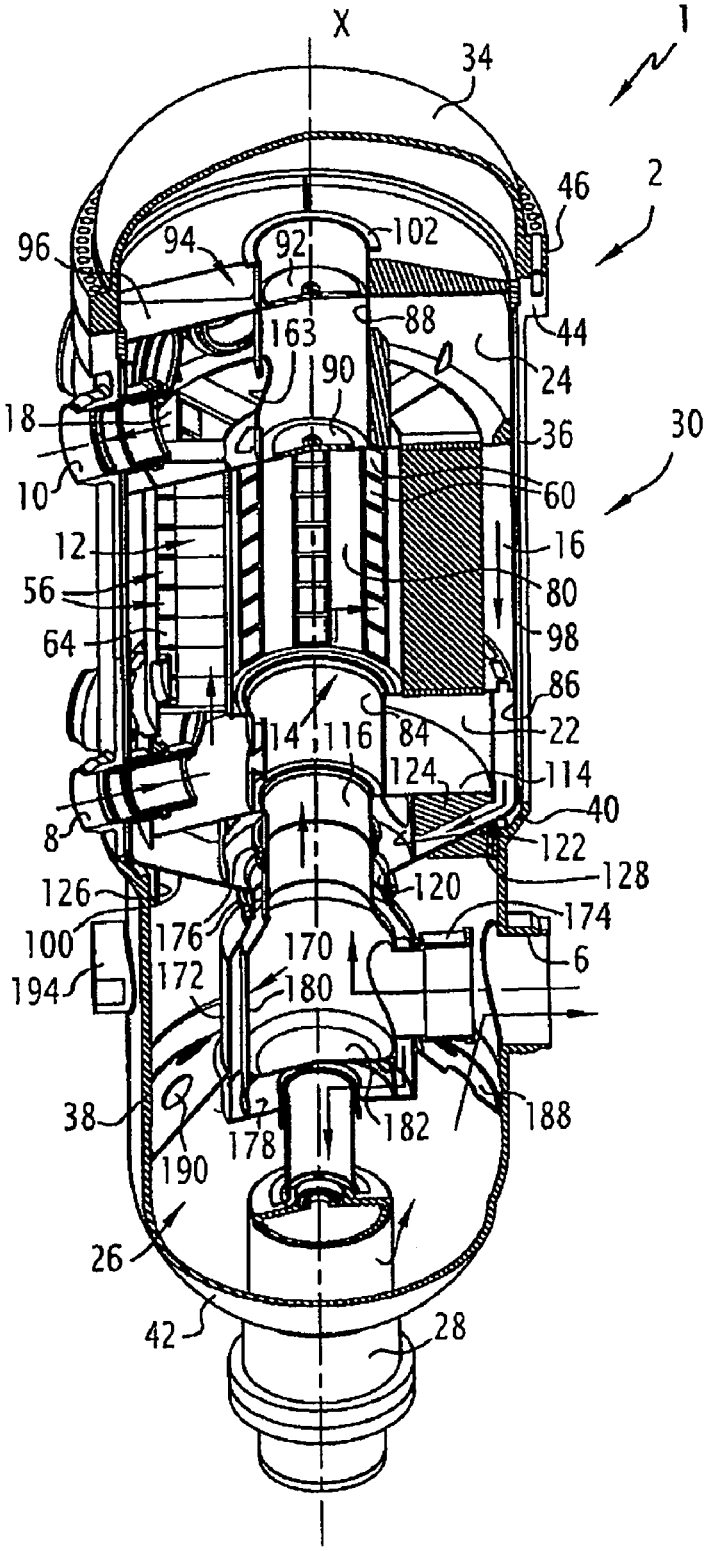
FIG. 1 is a perspective view of the heat exchanger assembly of the invention, cut away to reveal internal portions of the assembly.
Figure 2:
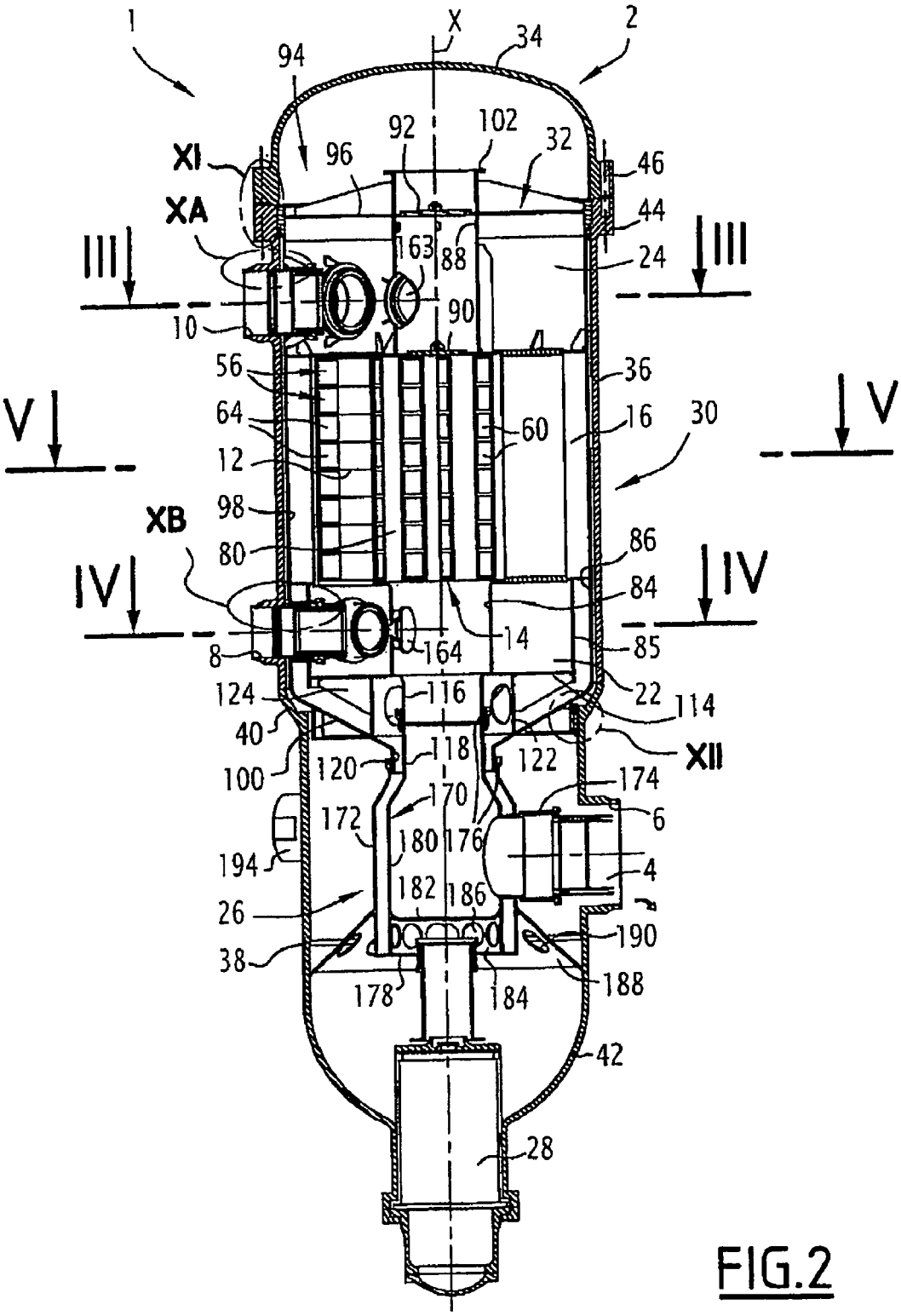
FIG. 2 is an axial section view of the FIG. 1 assembly on section plane II-II of FIG. 3.

The assembly 1 shown in FIGS. 1 and 2 is for use in a high temperature or very high temperature nuclear reactor (HTR/VHTR) for exchanging heat between a first fluid and a second fluid.

The first fluid is the primary fluid of the nuclear reactor, and it flows therethrough in a closed loop. It passes through the core of the nuclear reactor (not shown), then through the assembly 1, and finally returns to the inlet of the core. The primary fluid becomes heated in the reactor core, leaving it for example at a temperature of about 850° C. Inside the assembly 1, it yields a fraction of its heat to the secondary fluid, and it leaves the assembly 1 at a temperature of about 450° C., for example. The primary fluid is typically substantially pure gaseous helium.

The second fluid is the secondary fluid of the nuclear reactor and it flows therethrough in a closed loop. It passes through the assembly 1 and then passes through a gas turbine driving an electricity generator and returns to the inlet of the assembly 1. The secondary fluid enters into the assembly 1 at a temperature of about 405° C., for example, and it leaves it at a temperature of about 805° C., for example. The secondary fluid is a gas comprising mainly helium and nitrogen.

The assembly 1 comprises:

an outer enclosure 2 presenting a central axis 1 that is substantially vertical, provided with an inlet 4 and an outlet 6 for primary fluid, and four inlets 8 and four outlets 10 for the secondary fluid;

eight heat exchangers 12 disposed inside the enclosure 2, within which heat is exchanged between the primary and secondary fluids;

primary fluid flow manifolds 14 and 16 inside the enclosure 2;

secondary fluid flow manifolds 18 and 20 inside the enclosure 2;

an inlet chamber 22 distributing the secondary fluid amongst the manifolds 18, and an outlet chamber 24 collecting the secondary fluid at the outlets from the manifolds 20;

bottom internal equipments 26 channeling the primary fluid between firstly the manifolds 14 and 16 and secondly the primary fluid inlet and outlet 4 and 6; and a primary fluid circulator 28 secured to the enclosure 2.

The enclosure 2 comprises a vessel 30 within which the heat exchangers 12 and the manifolds 14, 16, 18, and 20 are disposed, the vessel presenting towards the top an opening 32 and a removable closure head 34 for closing the opening 32 of the vessel 30 in leaktight manner.

The vessel 30 comprises a cylindrical top shell 36, coaxial with the axis X, a cylindrical bottom shell 38 coaxial with the axis X that is disposed beneath the top shell 36 and that is of slightly smaller diameter than the shell 36, a frustoconical shell 40 interposed between the shells 36 and 38, and a rounded bottom 42 closing the bottom of the shell 38.

The top free edge of the shell 36 surrounds the opening 32 and forms a flange 44.

The closure head 34 is upwardly domed, and presents a free edge forming a flange 46 complementary to the flange 44 of the vessel 30. In a plane containing the axis X, the closure head 34 presents a top wall of section that constitutes substantially a portion of an ellipse.

Figure 11:
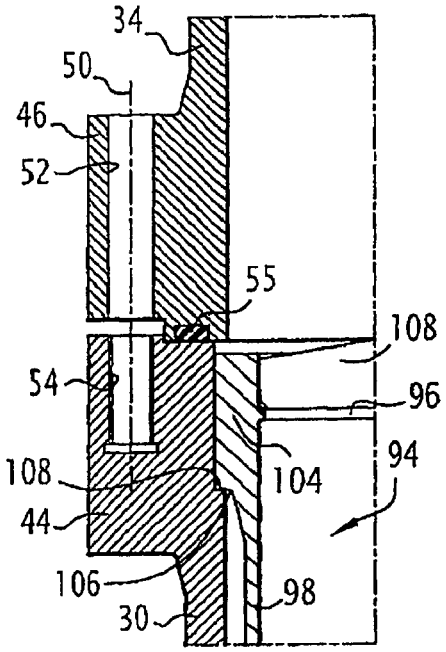
FIG. 11 is an enlarged view of portion XI of FIG. 2.

As can be seen in FIG. 11, the closure head 34 can be secured rigidly on the vessel 30 with the help of eighty tierods 50 engaged in holes 52 formed in the flange 46 and screwed into tapped orifices 54 formed in the flange 44. The flange 46 carries a highly leaktight metal gasket 55, e.g. of the type sold under the trade name "Helicoflex", providing sealing between the closure head 34 and the vessel 30 when they are fastened together.

Figure 4:
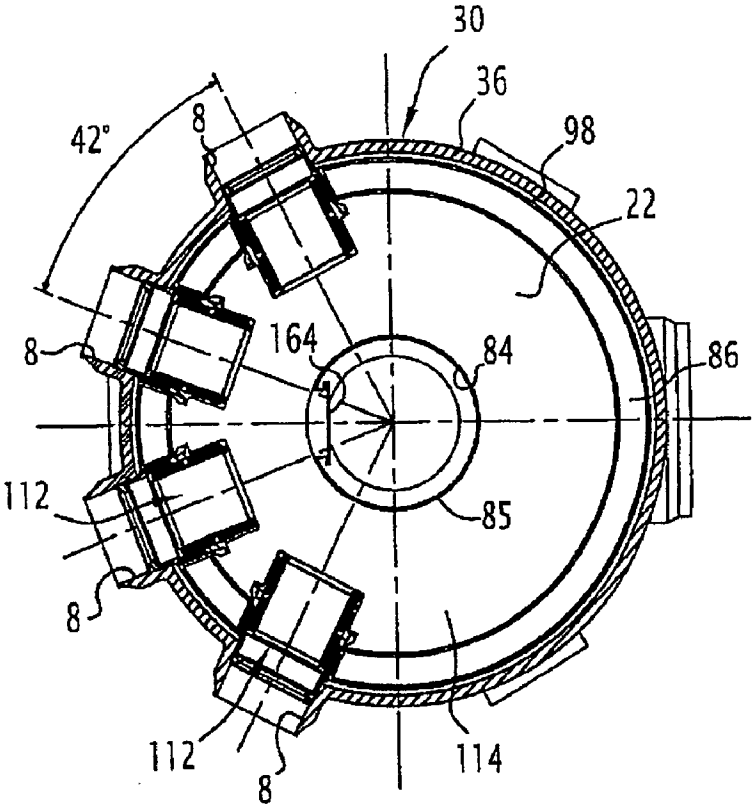
FIG. 4 is a section view of the FIG. 2 assembly taken perpendicularly to its axis on plane IV-IV of FIG. 2.

The secondary fluid inlets 8 are provided in the bottom of the shell 36 on a common circumference thereof. All four of them are disposed on one-half of the shell 36, as shown in FIG. 4. These inlets are circular, and they present axes disposed at 42° from one another.

Figure 3:
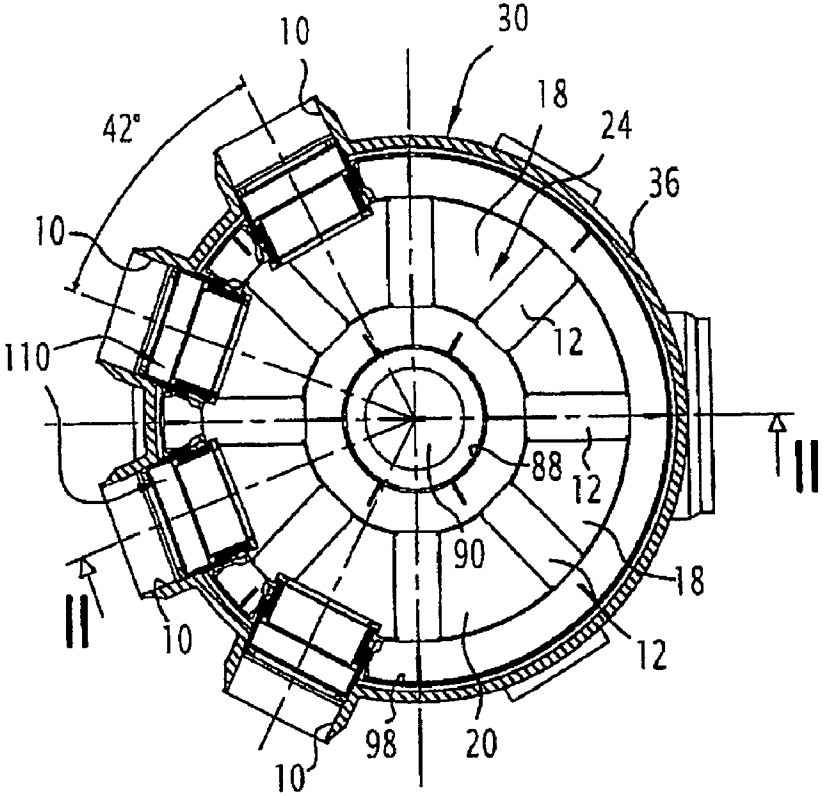
FIG. 3 is a section view of the FIG. 2 assembly, taken perpendicularly to its axis, on plane III-III of FIG. 2.

The secondary fluid outlets 10 are formed in the top of the top shell 36, and they lie on a common circumference of said shell (FIG. 3). They are situated in the same half of the shell 36 as are the inlets 8. Like the inlets, these outlets 10 are circular and their axes are spaced apart at 42°.

The bottom shell 38 has a single tapping point through which the primary fluid inlet 4 and outlet 6 are provided. The inlet 4 and the outlet 6 are coaxial, as shown in FIG. 2, with the outlet 6 surrounding the inlet 4.

The rounded bottom 42 bulges downwards, and presents a round central opening centered on the axis X and in which the circulation 28 is secured.

Figure 5:
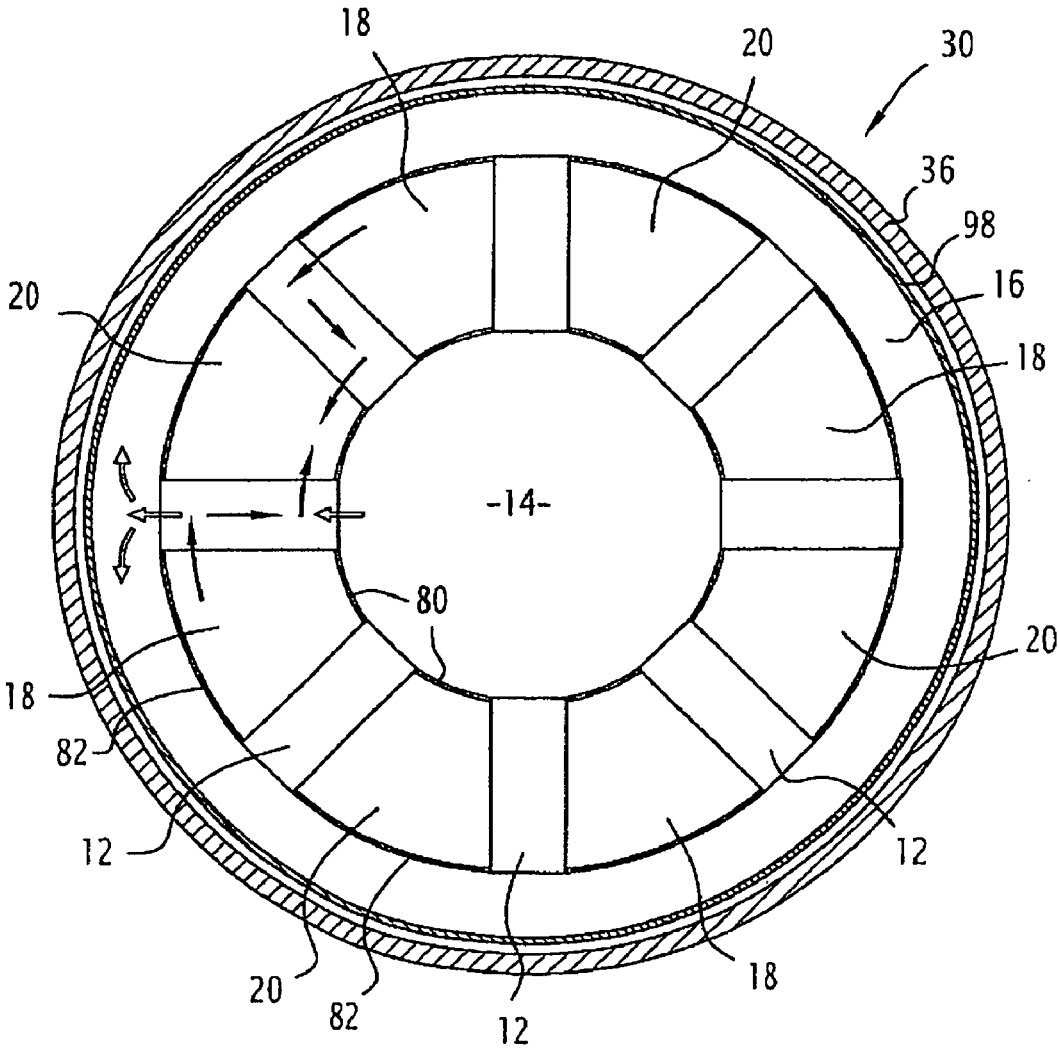
FIG. 5 is a section view of the FIG. 2 assembly taken perpendicularly to its axis on plane V-V of FIG. 2, showing the disposition of the heat exchangers.

As can be seen in FIG. 5, the eight heat exchangers 12 are disposed in a circle around the axis X, and they are regularly distributed thereabout.

The heat exchangers 12 are heat exchangers of the plate type. Each heat exchanger 12 comprises a vertical stack of eight mutually-identical modules 56.

Figure 7:
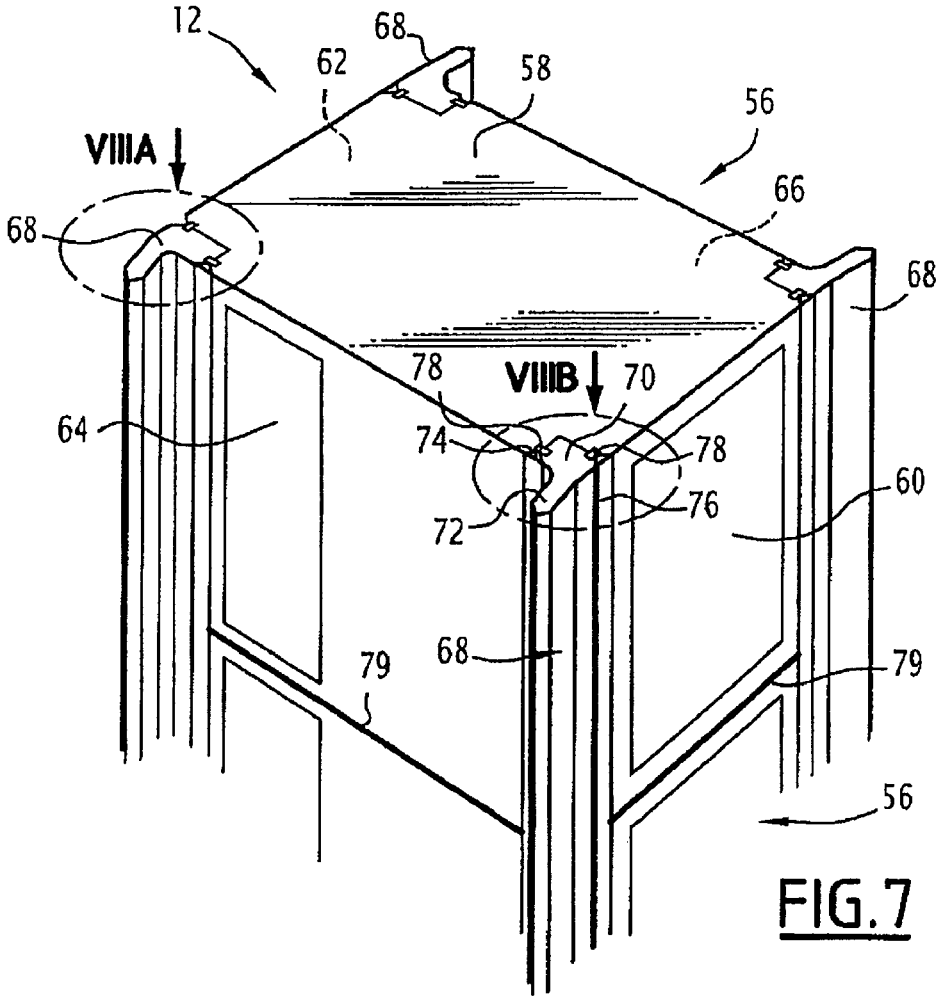
FIG. 7 is a perspective view of a module of a heat exchanger of FIGS. 1 and 2.

As shown in FIG. 7, each module 56 is in the form of a rectangular parallelepiped. Each module 56 comprises both an outer envelope 58 having inlet and outlet slots 60 and 62 for the primary fluid and inlet and outlet slots 64 and 66 for the secondary fluid machined therein, and also a plurality of plates 67 disposed inside the envelope 58 in an axial stack.

Figure 6A:
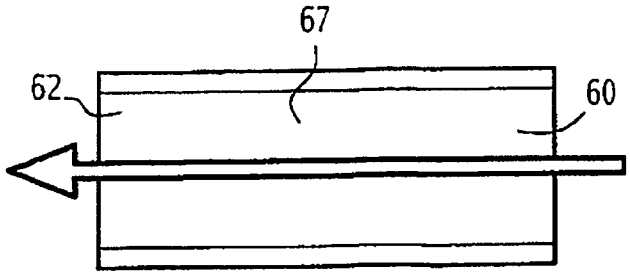
FIGS. 6A and 6B are diagrams showing the flow directions respectively of the first and second fluids through the heat exchangers of FIG. 5.
Figure 6B:
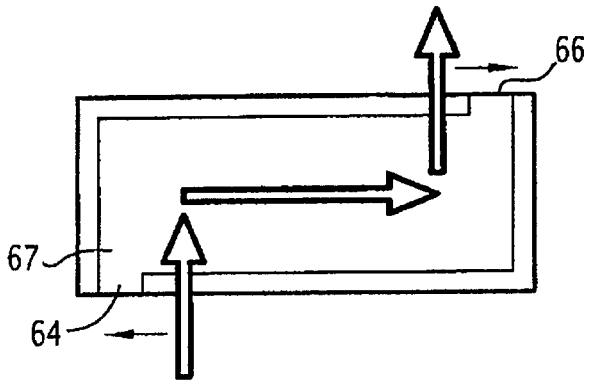
Figure 6C:
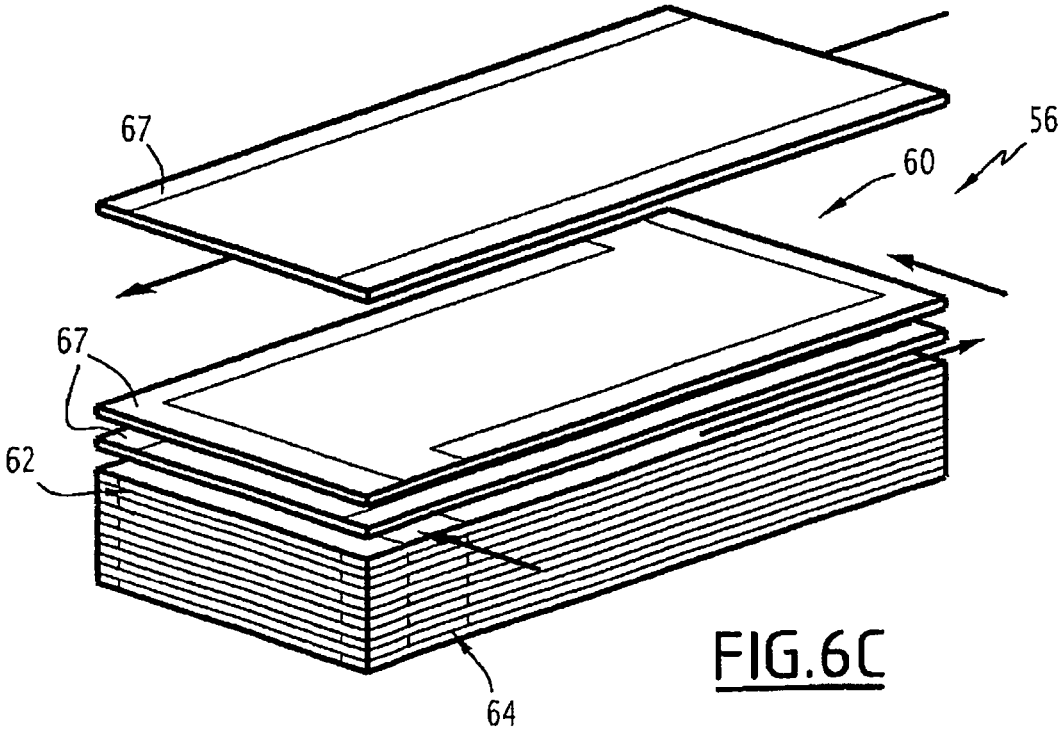
FIG. 6C is an exploded view of the plates of a FIG. 5 heat exchanger.

The slots 60 and 62 are disposed in two opposite faces of the envelope 58, facing respectively towards the inside and the outside of the assembly 1. The slots 64 and 66 are formed in two substantially radial and opposite faces of the envelope 58 (FIGS. 6A to 6C).

The stacked plates 67 define between them a plurality of primary fluid flow channels extending radially from the slot 60 to the slot 62.

The plates 67 also define between one another a plurality of secondary fluid flow channels extending substantially circumferentially from the slot 64 to the slot 66. It should be observed that the slot 64 is offset radially outwards from the slot 66, such that the secondary fluid follows a Z-shaped path through the module 56, as shown in FIG. 6B.

The primary and secondary fluid flow channels are superposed in alternation within the module 56, so as to improve the efficiency of heat exchange between the fluids.

The radial flow channels for the primary fluid do not open out along the two radial faces of the module 56, such that the secondary fluid cannot penetrate into said channels via the slots 64 and 66. Similarly, the substantially circumferential flow channels for the secondary fluid do not open out along the inside and outside faces of the module 56, such that the primary fluid cannot penetrate into these channels through the slots 60 and 62.

As shown in FIG. 7, the rectangular modules 56 present machined corners along the full axial height of the heat exchanger 12. The heat exchanger 12 also has forged and machined metal bars 68 disposed in the machined corners of the modules 56. These bars 68 extend over the full axial height of the heat exchanger 12. The modules 56 are welded to one another via their respective envelopes 58, and they are also welded to the metal bars 68.

Each bar 68 has both a main portion 70 of rectangular section perpendicularly to the axis X that is placed in a machined portion of a module 56, and a flange 72 projecting circumferentially relative to the module 56.

Figure 8A:
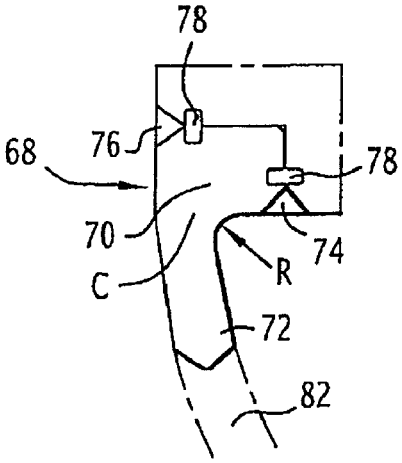
FIGS. 8A and 8B are enlarged plan views of portions VIIIA and VIIIB of FIG. 7.
Figure 8B:
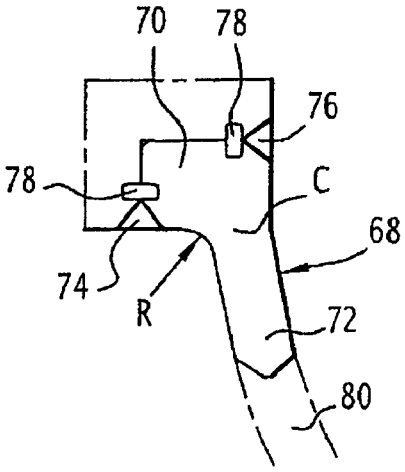

The main portion 70 is welded to the corresponding module 56 along two axial weld lines 74 and 76, visible in FIGS. 7, 8A, and 8B. The line 74 extends along radial faces of the modules 56, and the line 76 extends along inside faces or along outside faces of the modules 56, as appropriate.

It should be observed that the empty axial channels 78 are machined in the modules 56 and in the bars 68 behind the weld lines 74 and 76, and along the entire length thereof. The presence of these empty channels 78 enables the quality of the welds 74 and 76 to be verified by ultrasound.

It should be observed that the flanges 72 are connected to the radial faces of the modules 56 with a predetermined radius of curvature R that is determined in such a manner as to reduce stresses in the bars 68.

The modules 56 are also welded to one another along weld lines 79. These weld lines 79 follow the edges defining the inner and outer radial faces of the modules 56 at the tops and bottoms thereof.

The assembly 1 has four axial inlet manifolds 18 communicating with the secondary fluid inlet 8 via the inlet chamber 22, and four axial outlet channels 20 communicating with the secondary fluid outlet 10 via the outlet chamber 24.

The manifolds 18 and 20 are circumferentially interposed between the heat exchangers 12, as shown in FIG. 5. The axial inlet and outlet manifolds 18 and 20 are distributed in alternation around the central axis X, such that on going around the central axis X there are to be found in succession: a heat exchanger 12; an axial inlet manifold 18; a heat exchanger 12; an axial outlet manifold 20; a heat exchanger 12; an axial inlet manifold 18; etc. . . .

Each axial manifold 18 and 20 presents a section perpendicular to the axis X that is in the form of a sector of a ring, being defined towards the inside and towards the outside by respective circumferential sheets 80 and 82, and towards its sides by the radial faces of the heat exchangers 12 between which said manifold extends.

The inner and outer sheets 80 and 82 of a given axial manifold 18 or 20 are welded edge to edge on the flanges 72 of the bars 68 of the two heat exchangers 12 adjacent to the manifold. The shapes of the flanges 72 are determined so that these flanges lie in continuity with the inner or outer sheets 80 or 82 (FIGS. 8A and 8B).

The modules 56 are oriented in such a manner that the inlet window 64 opens out into an axial inlet channel 18, and the outlet window 66 opens out into an axial outlet channel 20.

The assembly 1 also includes a central manifold 14 extending along the axis X and communicating with the primary fluid inlet 4, and an annular channel 16 communicating with the primary fluid outlet 6.

The central manifold 14 extends radially inside the heat exchangers 12 and is defined by the bottom faces of the modules 56 and by the inner sheets 80. It presents a section perpendicular to the axis X that is substantially circular. The windows 60 open out into the central manifold 14.

The annular manifold 16 extends around the heat exchangers 12, radially outside them. It is defined inwardly by the outer sheets 82 and the outer faces of the modules 56. The windows 62 open out into the annular manifold 16.

The inlet and outlet chambers 22 and 24 for the secondary fluid are disposed respectively under the heat exchangers 12 and over the heat exchangers 12 (FIGS. 1 and 2).

The central manifold 14 extends axially downwards in the form of an intermediate cylindrical segment 84 disposed under the heat exchangers 12. Similarly, the annular manifold 16 extends axially downwards in the form of an intermediate annular segment 86 surrounding the intermediate cylindrical segment 84.

The inlet chamber 22 is annular in shape and is situated axially level with the secondary fluid inlet 8. It surrounds the intermediate cylindrical segment 84 and extends radially inside the intermediate annular segment 86. The inlet chamber 22 is defined radially outwards by a cylindrical wall 85.

Furthermore, the assembly 1 includes an inspection channel 88 extending the manifold 14 axially upwards beyond the heat exchangers 12. This inspection channel 88 is isolated from the central manifold 14 by a removable hatch 90. It is also closed upwards by another removable inspection hatch 92.

The outlet chamber 24 is also annular in shape and it surrounds the inspection channel 88.

The axial inlet channels 18 are downwardly open and communicate with the inlet chamber 22. They are upwardly closed and isolated from the outlet chamber 24. Conversely, the axial outlet channels 20 are downwardly closed and isolated from the inlet chamber 22 and they are upwardly open and communicate with the outlet chamber 24.

The annular manifold 16 is upwardly closed and does not communicate with the outlet chamber 24.

Figure 9:
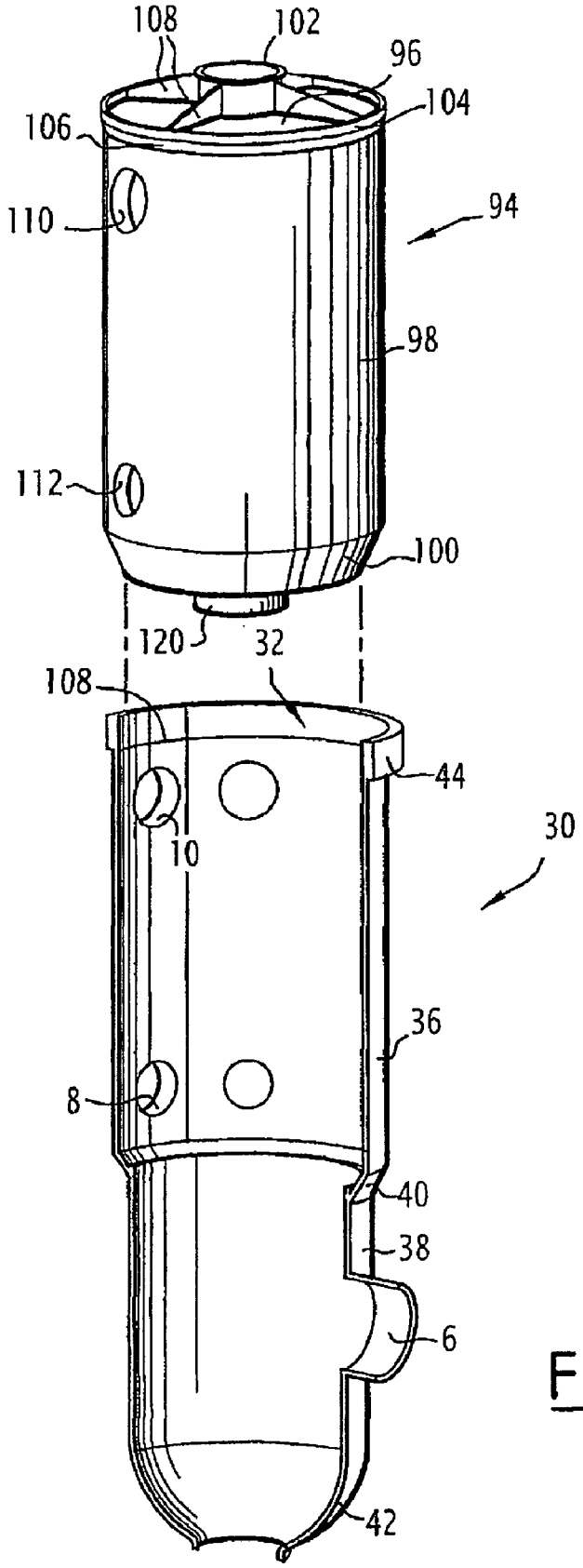
FIG. 9 is a fragmentary exploded view of the FIG. 1 assembly, showing the removable mechanical subassembly comprising the heat exchangers and the manifolds, decoupled from the bottom portion of the enclosure, said enclosure being shown partially cut away.

According to another important aspect of the invention, the heat exchangers 12, the inlet and outlet chambers 22 and 24, and the manifolds 14, 16, 18, and 20 are united in a mechanical subassembly 94 that can be extracted as a single piece from the enclosure 2. This subassembly is shown in FIG. 9.

The subassembly 94 is generally cylindrical in shape about the axis X.

The subassembly 94 is defined upwards by a plane circular plate 96, radially outwards by a cylindrical envelope 98, and downwards by a frustoconical envelope 100 extending the cylindrical envelope 98 downwards and converging therefrom. The top plate 96 defines the top of the outlet chamber 24 (FIGS. 1 and 2). The inspection channel 88 is extended upwards and projects above the plate 96 forming a mushroom-shaped part 102 for griping the subassembly 94. The hatch 92 is situated level with the top plate 96.

The subassembly 94 also comprises an engagement ring 104 surrounding the top plate 96 (FIG. 9) and projecting radially outwards relative to the envelope 98. On its underside, this ring 96 forms a bearing surface 106. On a radially inner side, the flange 94 has a complementary bearing surface 108 against which the bearing surface 106 rests when the subassembly 94 is placed inside the vessel 30.

The subassembly 94 also has four stiffeners 108 extending radially from the mushroom-shaped part 102 towards the ring 104.

The outer envelope 98 defines radially outwards the outlet chamber 24 and the annular manifold 16, and in particular the intermediate segment 86 of said manifold. It is pierced by four circular holes 110 in an upper portion and by four circular holes 112 in a lower portion, disposed respectively in register with the secondary fluid outlet 10 and the secondary fluid inlet 8 when the subassembly 94 is placed in the enclosure 2.

The subassembly 94 also has an annular horizontal floor 114 (FIGS. 1 and 2) defining the bottom of the inlet chamber 22 and extending between the respective segments 84 and 86 respectively of the central and annular manifolds 14 and 16.

Furthermore, the central manifold 14 extends under the segment 84 in the form of a bottom cylindrical segment 116 of axis X and terminates downwards by a free edge 118 (FIG. 2).

The frustoconical envelope 100 surrounds the bottom segment 116 and is downwardly terminated by a cylindrical rim 120 of axis X. The annular segment 86 of the annular manifold 16 opens out downwards between the bottom segment 116 and the frustoconical envelope 100.

It can be seen in FIG. 1 that the subassembly 94 includes a stiffener shell 122 that is disposed around the bottom segment 116 and that is perforated to allow the primary fluid to flow therethrough. This bottom shell 122 is welded at the top to the floor 114 and at the bottom to the frustoconical shell 100. Radial stiffeners 124 are welded simultaneously to the floor 114, to the frustoconical shell 100, and to the bottom shell 122, and they increase the stiffness of the subassembly 94 in its bottom portion.

Figure 12:
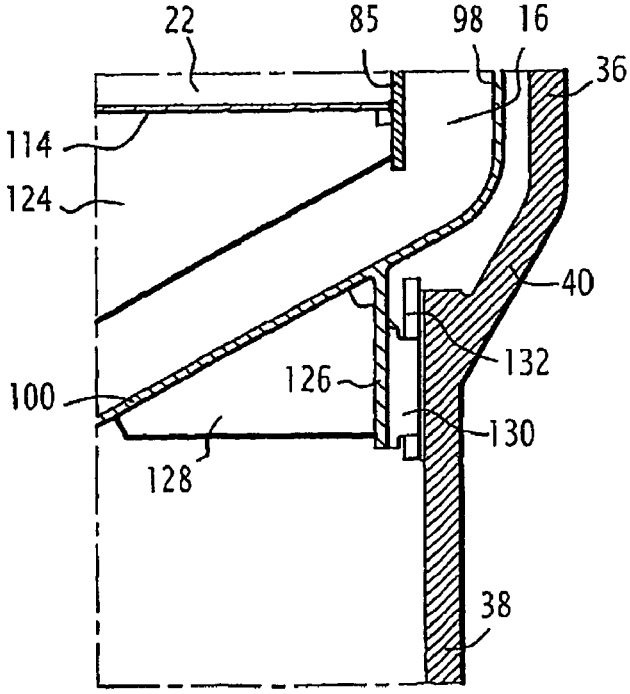
FIG. 12 is an enlarged view of portion XII of FIG. 2.

An outer cylindrical shell 126 (FIG. 12) is welded under the frustoconical envelope 100. It extends close to the frustoconical shell 40 of the vessel 30. This outer shell is reinforced by six radial stiffeners 128 welded both to the frustoconical envelope 100 and to the outer shell 126. Between them, these stiffeners 128 carry three keys 130, shown in FIG. 12, cooperating with axial grooves 132 formed in the shell 40 of the vessel 30. The keys 130 and the grooves 132 are disposed at 120° from one another about the axis X and enable the subassembly 94 to be indexed in rotation about the axis X.

The outlet chamber 24 is connected in leaktight manner to the secondary fluid outlet 10 via outer and inner sleeves 140 and 142, that can be seen in FIG. 1A. The outer sleeve 140 is screwed onto an annular part 144 welded in the outlet 10. It is tubular in shape and extends from the outlet 10 towards the inside, so as to be engaged in the hole 110 of the outer envelope 98. The fastener screws 146 are accessible from inside the outlet chamber 24.

The hole 110 is surrounded by an edge 148 projecting towards the inside of the outlet chamber 24 from the envelope 98. The inner sleeve 142 is tubular in shape and is interposed between the outer sleeve 140 and the projecting edge 148. It is fastened by screws 150 to the free end of the projecting edge 148.

Highly leaktight metal gaskets of known type, as sold under the trade name "Helicoflex", are interposed firstly between the outer sleeve 140 and the ring-shaped part 144, and secondly between the inner sleeve 142 and the projecting edge 148.

Furthermore, a tubular bellows 154 interconnects the sleeves 140 and 142 in leaktight manner. The sleeves 140 and 142 are free to slide relative to each other in a radial direction relative to the axis X, with sealing being maintained by the bellows 144.

Blocks of lagging 156 isolate the bellows 154 and the screws 146 from the secondary fluid flowing from the outlet chamber 24 towards the outlet 10.

Figure 10A:
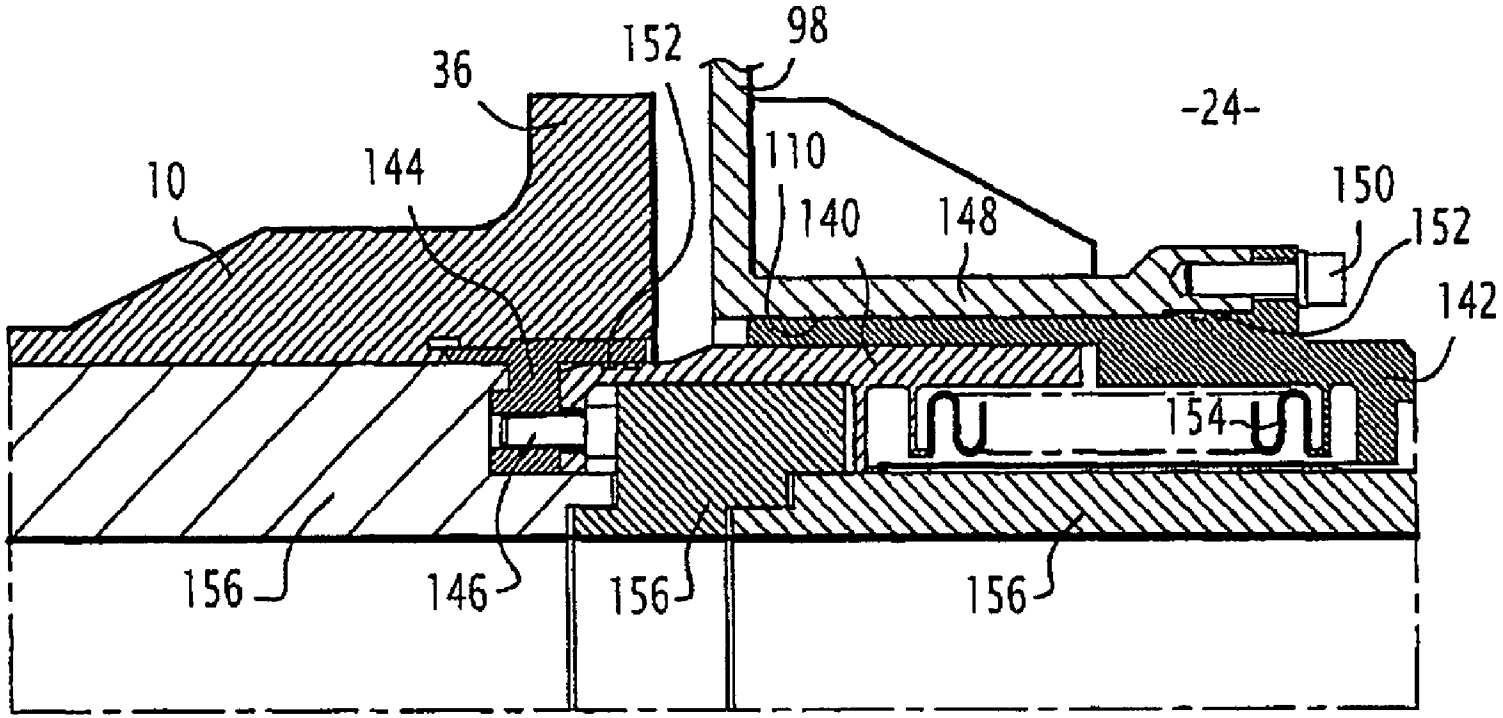
FIGS. 10A and 10B are enlarged views of portions XA and XB of FIG. 2.
Figure 10B:
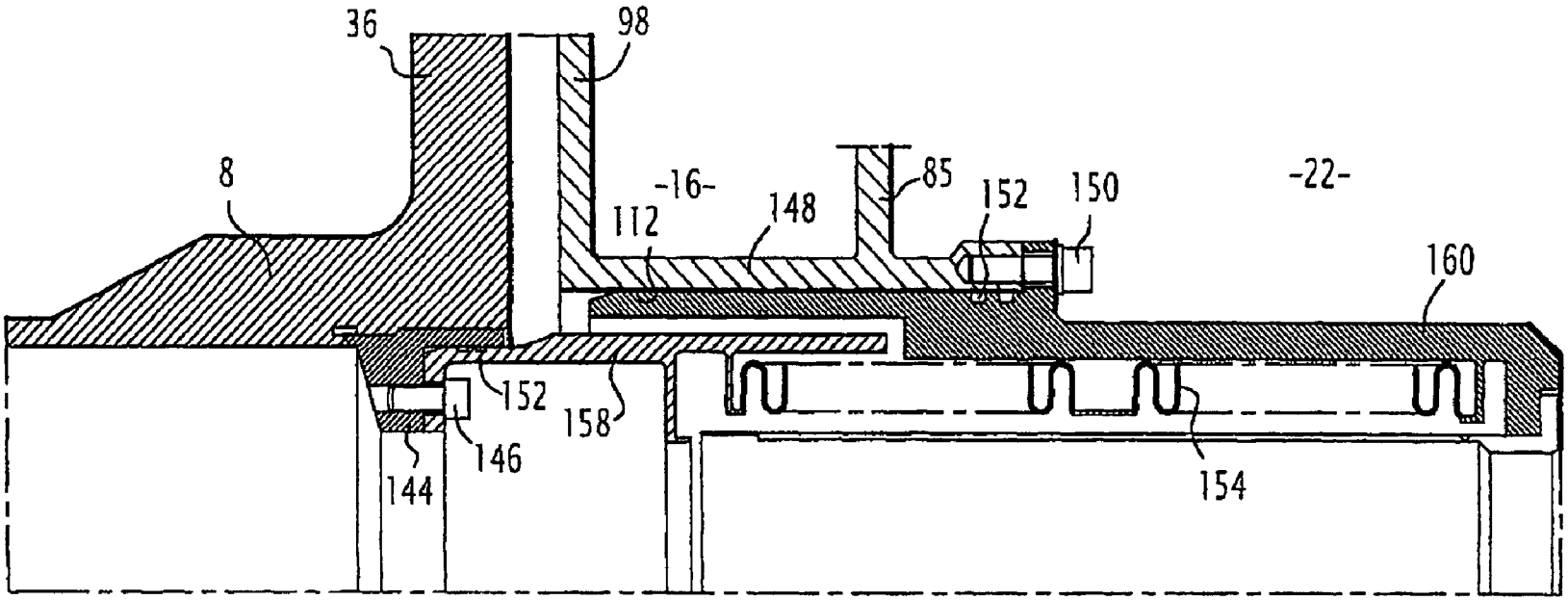

The inlet chamber 22 is connected in leaktight manner to the inlets 8 by outer and inner sleeves 158 and 160 similar to the outer and inner sleeves 140 and 142 described above (FIG. 10B). Nevertheless, it should be observed that in this example the projecting edge 148 extends from the outer envelope 98 beyond the cylindrical wall 85 to the inside of the inlet chamber 22. The cylindrical wall 85 is welded to the projecting edge 148. The projecting edge 148 thus serves to provide a leaktight passage from the inlet chamber 22 through the annular intermediate segment 86 of the manifold 16, to the outer envelope 98. Furthermore, it should be observed that the outer and inner sleeves 158 and 160 and the bellows 154 are not lagged, given the moderate temperature of the secondary gas at its inlet to the assembly 1.

The inspection channel 88 has a large opening (163) that gives access to the systems for disconnecting the outlet chamber 24. The intermediate segment 84 of the manifold 14 has an inspection hole 164 communicating with the inlet chamber 22 (FIG. 2). This inspection hole 164 is closed in leaktight manner by a removable hatch. An inspection hole (not shown) provided with a removable hatch gives access to the annular channel 16 from one of the axial outlet channels 20.

The bottom inner equipments 26 comprise bottom inlet and outlet manifolds 170 and 172 coaxial about the axis X and communicating respectively with the primary fluid inlet 4 and outlet 6 (FIG. 2). The bottom outlet manifold 172 surrounds the bottom inlet manifold 170. The bottom inlet manifold 172 is connected to the inlet 4 by radial pipework 174 passing through the bottom outlet manifold 172. The manifold 172 is welded in leaktight manner around the pipework 174.

The bottom inlet and outlet manifolds 170 and 172 are both terminated upwards by flanges 176 suitable for receiving in leaktight manner the free edge 118 of the central manifold 14 and the edge 120 of the frustoconical envelope 100 merely by mutual engagement. Towards the inside, the flanges 176 present frustoconical bearing surfaces that serve to guide the free edge 118 and the rim 120. Furthermore, the edge and the rim carry outer metal gaskets providing leaktight contact with the inside faces of the flanges 176.

The bottom outlet manifold 172 is closed downwards by a bottom wall 178 extending perpendicularly to the axis X. The bottom inlet manifold 170 comprises a cylindrical shell 180 about the axis X and extending as far as the bottom wall 178, and its own bottom wall 182 perpendicular to the axis X and closing the shell 180 at an intermediate level between the pipework 174 and the bottom wall 178.

The bottom wall 178 is pierced by a central opening 184 receiving the suction side of the circulator 28. The shell 180 also presents through openings 186 under the bottom wall 182, thus creating a path allowing the primary fluid to pass from the bottom outlet manifold 172 through the openings 186 into the volume that extends between the bottom walls 178 and 182, and then to the suction side of the circulator 28.

Furthermore, the bottom internal equipments 26 include another frustoconical shell 188 that converges upwards, with its large base welded to the bottom shell 38 of the vessel 30 and with its small base welded around the bottom outlet manifold 172. The frustoconical shell 188 has through openings 190. These openings put the volume situated beneath the bottom inlet and outlet manifolds 170 and 172 into communication with the volume situated around said bottom manifolds.

The primary fluid outlet 6 opens out directly into the volume situated around the bottom manifolds 170 and 172.

The circulator 28 delivers the primary fluid through the radial openings in the rounded bottom wall 42, with the primary fluid being suitable for flowing upwards from there through the openings 190 and on via the outlet 6.

Figure 13:
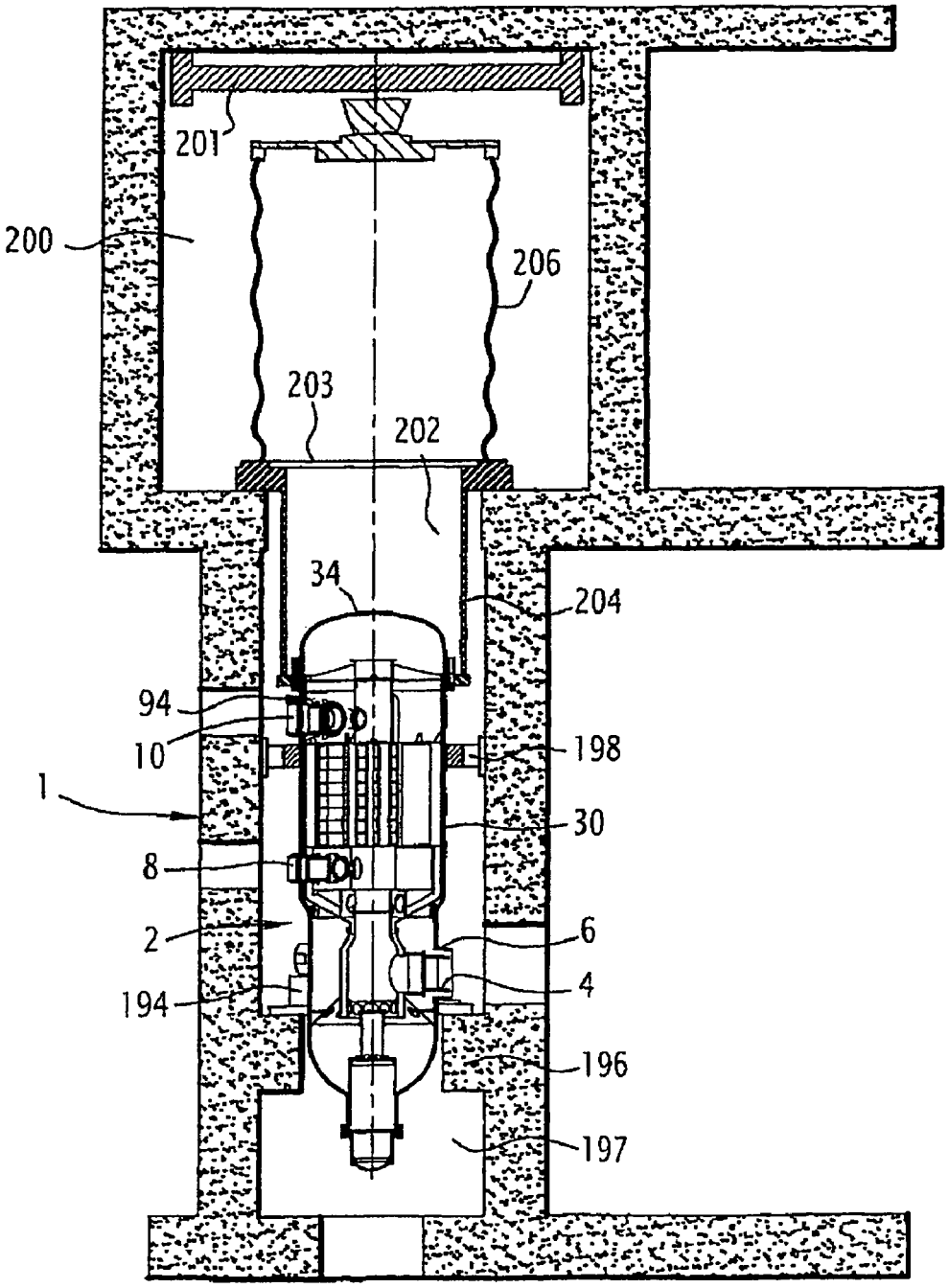
FIG. 13 is a diagram summarizing the means implemented in a nuclear reactor for withdrawing the FIG. 10 mechanical subassembly from the outer enclosure.

Finally, the vessel 30 includes three support blocks 194 integrated with and welded to the bottom shell 38. The blocks 194 are disposed at 120° to one another around the axis X. As shown in FIG. 13, the assembly 1 rests via the blocks 194 on concrete foundations 196 projecting from the walls of the cell 197 in which the assembly 1 is disposed.

Buttresses 198 interposed between the walls of the cell and the top shell 36 of the vessel 30 serves to stabilize the assembly 1 in the vertical position.

The hottest portions of the assembly 1 are lagged, e.g. by blocks comprising $Al_2O_3$ fibers or carbon fibers. These portions operate at temperatures that are close to or greater than 800° C. in nominal operation. They comprise the pipework 176, the bottom inlet manifold 170, the central manifold 14, including its intermediate and bottom segments 84 and 116, the axial outlet manifolds 20, the outlet chamber 24, and the sleeves 140 and 142 connecting the outlet chamber 24 to the secondary fluid outlets 10.

The enclosure 2 presents a total height of about 27 meters (m), and a diameter of about 7 m. The cylindrical envelope 98 presents a diameter of about 6300 millimeters (mm).

Each heat exchanger 12 presents an axial height of about 4800 mm, a radial depth of about 1300 mm, and a circumferential width of about 560 mm. Each module 56 presents a height of about 600 mm.

The diameter of the central manifold 14 is about 2800 mm. It is determined in such a manner that the inner sheets 80 defining the axial manifolds 18 and 20 present flexibility and respective developed lengths in the circumferential direction that are sufficient to accommodate the deformation that the heat exchangers 12 impose in a plane perpendicular to the axis X.

The radial depth of the annular manifold 16 is about 500 mm. It is determined in such a manner as to make it possible for an operator to pass inside the annular manifold 16 so as to carry out inspections and/or repairs on the outside faces of the heat exchangers 12.

The secondary fluid inlets 8 present through diameters of at least 850 mm, and the secondary fluid outlets 10 present through diameters of at least 1 m.

The assembly 1 is dimensioned, for example, for a primary fluid pressure of about 50 bars, a primary fluid flow rate of about 200 kilograms per second (kg/s), a secondary fluid flow rate of about 600 kg/s, and a pressure difference in normal operation between the primary and second fluids of about 5 bars.

There follows a description of the flow paths of the primary and secondary fluids through the assembly 1 (see FIG. 1).

The primary fluid enters into the assembly 1 via the inlet 4, passes into the pipework 174, into the bottom inlet manifold 170, and then into the central manifold 14. It is delivered from the central manifold 14 to the various heat exchangers 12 distributed around the central manifold, it passes radially through the heat exchangers to the annular manifold 16 while yielding a fraction of its heat to the secondary fluid. The primary fluid then flows downwards along the annular manifold 16, along its bottom portion 86, passes through the openings in the perforated shell 122, and then flows around the bottom segment 116 of the central manifold 14, and then between the bottom manifold 170 and the bottom manifold 172. Thereafter the primary fluid passes through the openings 186 in the shell 180, is sucked into the circulator 28 and is delivered radially into the bottom of the vessel 30. Thereafter it passes through the openings 190 in the frustoconical shell 188 and leaves the assembly 1 via the outlet 6 formed around the inlet 4.

The secondary fluid enters into the assembly 1 via the inlets 8, flows through the sleeves 158 and 160 to the inlet chamber 22, and is then distributed from the inlet chamber 22 into the various axial inlet manifolds 18. The secondary fluid passes through the heat exchangers 12 circumferentially and is collected in the axial outlet manifolds 20. It travels along the manifolds 20 axially to the outlet chamber 24 and is delivered from the chamber 24 to the various outlets 10.

The procedures for maintaining the assembly 1 are described below.

In the event of a minor action to be carried out on the heat exchangers 12, e.g. plugging a flow channel for the primary fluid or the secondary fluid, an operator acts directly on the heat exchangers 12 while they remain in place inside the enclosure 2.

For this purpose, the closure head 34 is initially removed from the outer enclosure 2. Thereafter, the operator opens the hatch 92 and moves into the inspection channel 88. If the repair is to be made on a face of a heat exchanger 12 that faces towards an axial outlet channel 20, the operator passes through the opening 163 (FIG. 2) and penetrates into the outlet chamber 24, then going down inside the appropriate axial outlet manifold from the chamber 24.

If the repair is to be made on an outside face of a heat exchanger 12, the operator penetrates into the annular manifold 16 from the chamber 24 via the axial outlet channel 20 presenting an inspection hole, and carries out the repair from the manifold 16.

If the action is to be performed on an inside face of a heat exchanger 12, the operator opens the hatch 90 and goes from the inspection channel 88 to the central manifold 14. The repair is carried out from the central manifold 14.

If the action is to be performed on a side of a heat exchanger 12 facing towards an axial inlet manifold 18, the operator moves down along the central manifold 14 to the intermediate segment 84, opens the hatch 164, penetrates into the inlet chamber 22, and moves up inside the appropriate axial inlet manifold 18 from the chamber 22.

If a major repair is to be performed on the heat exchangers 12, e.g. replacing a module 56, then it is necessary initially to remove the subassembly 94 from the vessel 30. For this purpose, a maintenance cell 200 (FIG. 13) is provided above the cell 197 in which the assembly 1 is located. These two cells communicate via an opening 202 that is closed by an isolating hatch 203 extending above the assembly 1.

Initially, a sealing ring 204 is placed around the top portion of the assembly 1. Gaskets provide sealing firstly between the ring 204 and the flange 44 of the vessel 30, and secondly between the ring 204 and the peripheral edge of the hatch 202. A vinyl sock 206 is placed above the sealing ring 204 and is suspended from the lifting beam of the bridge crane 201 in the cell 200.

The closure head 34 is removed initially from the enclosure 2 using the crane 201. Thereafter the enclosure 2 is isolated from the maintenance cell 200 by putting the hatch 203 into place while removing the closure head 34. After the vinyl sock 206 has been put into place and the hatch 203 has been opened, operators penetrate into the outlet chamber 24 through the hatch 92 and the opening 163. They then remove the blocks of lagging 156 that protect the sleeves 140 and 142, and then undo the screws 146 and 150 using appropriate tools. Once the sleeves 140 and 142 have been released, the operators pull the sleeves into the inside of the outlet chamber 24 (using special tooling). They proceed in this manner for all four secondary fluid outlets 10.

Thereafter, the operators penetrate into the inlet chamber 22 via the hatches 90 and 164. They release the sleeves 158 and 160 connecting the secondary fluid inlets 8 to the inlet chamber 22 and they use special tooling to pull the sleeves into the inside of the chamber.

They then leave the assembly 1.

The beam of the crane 201 is then coupled to the mushroom 102 of the subassembly 94. The subassembly is then lifted by raising the beam of the crane 201, thereby extracting the subassembly from the vessel 30, and it is lifted through the hatch 202 into the cell 200. It is then located inside the vinyl sock 206, being isolated from the enclosure 1 by reclosing the hatch 202. The crane then moves inside the maintenance cell 200 so as to put the subassembly 94 down onto an appropriate reception stool. Major maintenance operations are then performed in the cell 200.

The subassembly 94 is put back into place inside the vessel 30 by a procedure that is exactly the reverse of the procedure described above.

The subassembly 94 needs to be guided in turning about the axis X while being put back into place so as to cause the indexing keys 130 to engage in the appropriate grooves 132.

Once the bearing surface 106 of the flange 104 bears on the complementary bearing surface 108 of the vessel 30, the beam of the crane 201 is uncoupled from the grip mushroom 102.

The maintenance cell 200 may be common to a plurality of assemblies 1, all serving the same nuclear reactor, or indeed serving a plurality of different nuclear reactors.

The above-described assembly presents numerous advantages.

The axial manifolds 18 and 20 open out into the inlet and outlet chambers 22 and 24 and they are not directly connected mechanically to the secondary fluid inlets and outlets 8 and 10. This configuration is favorable in terms of differential expansion between the inlets and outlets 8 and 10 connected to the vessel and the chambers 22 and 24 belonging to the heat exchanger subassembly 94, thereby considerably restricting thermomechanical stresses on these connections.

The disposition of the heat exchangers 12 and of the axial outlet and inlet manifolds 18 and 20 enables the manifolds 18 and 20 to be given respective large through sections. The axial speed of flow of the secondary fluid along these manifolds lies for example in the range 10 meters per second (m/s) to 20 m/s. In other heat exchanger designs, these speeds can be as great as 60 m/s. Slower speeds are favorable for maintaining hydraulic equilibrium between the secondary fluid inlets and outlets 64 and 66 in each manifold 56 during normal operation. These smaller speeds also enable the secondary fluid to be distributed uniformly amongst the various modules 56 stacked along a given axial manifold 18, and from a thermohydraulic point of view, they are favorable during transient operation. The overall efficiency of the heat exchangers 12 is improved.

The thermomechanical behavior of the manifolds is also particularly favorable. The axial manifolds 18 and 20 are defined by inner and outer circumferential sheets 80 and 82 that are flexible, deforming easily under the effect of the stresses imposed by the heat exchangers 12. The heat exchangers 12 are blocks that are very rigid compared with the sheets 80 and 82, which means that deformation is imposed on the sheets. The sheets 80 and 82 constitute thin shells of large radius of curvature, thereby giving them a large amount of flexibility.

The inlet and outlet chambers 22 and 24 are of large size and they do not have internal partitions. As a result, the inlet chamber allows the secondary fluid to be distributed uniformly amongst the various axial inlet manifolds 18. Furthermore, because of their large through sections, these chambers offer little resistance to the flow of secondary fluid. They also provide easy access to the inlets 8 and outlets 10, and thus enable the sleeves 140, 142, 158, and 160 to be disconnected easily and quickly from the inlets 8 and outlets 10.

Finally, because the chambers do not have any internal partitioning, it is possible to place all of the inlets 8 and outlets 10 on the same side of the enclosure 2.

It is thus possible to place the assembly 1 close to one of the walls of the cell 97, since the inlet and outlet pipework for the secondary fluid is all located away from that wall.

The subassembly 94 containing all of the heat exchangers and the main primary and secondary fluid flow manifolds can be withdrawn as a single piece from the outer enclosure 2. This operation is performed in a manner that is particularly simple and convenient, using the crane in the maintenance cell situated above the heat exchanger assembly 1, after removing the closure head 34 and withdrawing the sleeves 40 and 42 into the inlet and outlet chambers 22 and 24. The sleeves 40 and 42 are retracted quickly and easily using special tools, such that the doses of radiation to which the operators are exposed are small.

Once the sleeves 140 and 142 have been retracted, the subassembly 94 is extracted from and reinserted into the enclosure 2, merely by mutual disengagement and engagement.

The bottom manifolds 170 and 172 present flanges 176 of shape adapted to guide the bottom portion of the subassembly 94 while it is being put back into place. The central manifold 14 and the annular manifold 16 are connected in leaktight manner with the bottom manifolds 170 and 172, merely by mutual engagement in a vertical direction.

Major maintenance operations are performed on the heat exchangers 12 in convenient manner in a special maintenance cell that is fitted with suitable equipment.

Furthermore, small repairs can be carried out on the heat exchangers 12 in situ, i.e. without withdrawing the subassembly 94 from the enclosure 2. The central manifold, the annular manifold, and the axial inlet and outlet manifolds present sections that are of sufficiently large size to enable an operator to enter them and work inside them. The heat exchangers 12 are accessible on all four faces for repair.

The modules 56 constituting each heat exchanger 12 are welded to one another along edges that define, upwards and downwards, the inner, outer, and radial faces of these modules. Corner welds are eliminated by the presence of the bars 68 disposed in the machined corners of the modules 56.

The inner and outer circumferential sheets 80 and 82 are welded to the flanges 72 of the bars 68. This welding is situated at a distance from the modules 56 and can be inspected in practical manner using X-rays.

The critical zone C in which thermomechanical stresses are at a maximum (see FIGS. 9A and 9B) is situated at the junction between a flange 72 and the main portion 70 of a bar 68, so this zone extends in the material of the bar 68 and not in the weld.

Finally, the flanges 72 are connected to the radial faces of the modules 56 via radii of curvature (R) that are optimized as a function of the thermomechanical stresses in the critical zones C.

These various constructional dispositions enable the heat exchangers 12 to be made to be particularly good at withstanding thermomechanical stresses.

The heat exchanger assembly described above may present numerous variants.

Thus, for example, the heat exchangers 12 need not be plate type heat exchangers, but they could be heat exchangers of the type having tubes and shells.

The circulator 28 need not be disposed at the bottom of the vessel 30, but could be secured to the closure head 34. It is then necessary to modify the path followed by the primary fluid leaving the heat exchangers 12. The annular manifold 16 is extended upwards towards the circulator 28 and is partitioned so as to define an up portion, channeling the primary flow to the circulator 28, and a down portion, channeling the primary flow from the circulator 28 to the outlet 6.

This makes removing the subassembly 94 more complex, since it is necessary to begin by removing the circulator 28 before removing the closure head 34 from the enclosure 2.

The heat exchanger assembly may have a number of heat exchangers 12 that is greater than or less than eight.

The secondary fluid inlets 8 could be disposed at the top of the top shell 36, with the secondary fluid outlets 10 then being disposed beneath the exchangers 12.

The primary fluid can flow from the inlet 4 towards the heat exchangers 12 in the annular manifold 16 and return from the heat exchangers to the outlet 6 via the central manifold.

The primary fluid could flow from the inlet chamber 22 through the axial channels 18 and 20 to the outlet chamber 24, with the secondary fluid then flowing through the central manifold 14 and the annular manifold 16.

The primary fluid need not be substantially pure helium, but could be a mixture of helium and nitrogen. The primary fluid could also mainly comprise water.

The secondary fluid may be substantially pure helium or a mixture of helium and nitrogen (e.g. 20% helium and 80% nitrogen or 40% helium and 60% nitrogen). The secondary fluid may also be constituted mainly by water, and may be vaporized within the heat exchanger assembly. Under such circumstances, the heat exchanger acts as a steam generator.

It should be observed that the heat exchanger assembly 1 described above presents several original aspects suitable for being protected independently of one another.

Thus, it is possible to make provision for the assembly 1 to have a mechanical subassembly that can be extracted in a single piece such as the subassembly 94, even though the axial manifolds 18 and 20 are connected to the inlets 8 and outlets 10 via connecting pipework and not via chambers such as 22 and 24. Under such circumstances, the terminal portions of the connecting pipework should be suitable for being disconnected manually from the inlets and outlets 8 and 10, e.g. from the empty space between the closure head 34 and the heat exchangers 12 and from the empty space lying between the frustoconical envelope 100 and the heat exchangers 12. These terminal portions are retracted into the inside of the connection pipework, or they are completely separated therefrom and extracted manually from the enclosure 2 by the operators.

Similarly, it is possible to make provision for the assembly 1 to have heat exchangers 12 provided with bars 68 of the kind described above while the axial manifolds 18 and 20 are not connected to the inlets 8 and outlets 10 by chambers 22 and 24 and/or it is possible for the assembly 1 not to include a subassembly 94 that can be removed.

The invention claimed is:

1. A heat exchanger assembly for exchanging heat between a first fluid and a second fluid, the assembly comprising:

an outer enclosure presenting a central axis and provided with at least one inlet and outlet for the first fluid and with at least one inlet and outlet for the second fluid;

a central manifold extending along the central axis and communicating with one of the inlet and the outlet for the first fluid;

an annular manifold disposed around the central manifold and communicating with the other one of the inlet and the outlet for the first fluid;

a plurality of heat exchangers distributed around the central axis and radially interposed between the central manifold and the annular manifold;

a plurality of axial inlet manifolds communicating with the inlet(8) for the second fluid, and a plurality of axial outlet manifolds communicating with the outlet for the second fluid, the axial inlet and outlet manifolds being circumferentially interposed between the heat exchangers; and each heat exchanger comprises a plurality of channels for flow of the first fluid between the central and annular manifolds, and a plurality of channels for flow of the second fluid from at least one inlet manifold towards at least one outlet manifold;

the assembly including an inlet chamber provided at a first axial end of the heat exchangers and putting the inlet(s) for the second fluid into communication with at least a plurality of axial inlet manifolds.

2. An assembly according to claim 1, wherein the inlet chamber is annular in shape and surrounds the central manifold.

3. An assembly according to claim 1, including an outlet chamber provided at a second axial end of the heat exchangers opposite from the first axial end and putting the outlet(s) for the second fluid into communication with at least a plurality of axial outlet manifolds.

4. An assembly according to claim 3, including an inspection channel extending the central manifold axially from the second end, and isolated therefrom by a removable hatch, the outlet chamber being annular in shape and surrounding the inspection channel.

5. An assembly according to claim 4, wherein at least the heat exchangers, the inlet and outlet chambers, and the axial inlet and outlet manifolds are united in a mechanical subassembly that can be extracted as a single piece from the enclosure.

6. An assembly according to claim 5, wherein the enclosure has a vertical central axis, the enclosure comprising a vessel within which the subassembly is disposed and presenting towards the top an opening for extracting said subassembly, and a removable closure head for closing the opening of the vessel in leaktight manner.

7. An assembly according to claim 6, wherein the vessel comprises a cylindrical shell coaxial with the central axis and having the inlet and outlet for the second fluid formed therein, the inlet and outlet chambers being connected in leaktight manner to the inlet and outlet for the second fluid by removable sleeves that can be retracted into the chambers.

8. An assembly according to claim 7, wherein the sleeves are suitable for being dismounted from inside the chambers.

9. An assembly according to claim 7, wherein the enclosure has a plurality of inlets for the second fluid and a plurality of outlets for the second fluid, these inlets and outlets being brought together in a single circumferential half of the shell.

10. An assembly according to claim 6, wherein the subassembly comprises a cylindrical outer envelope coaxial about the central axis, defining the outlet chamber and the annular manifold radially outwards.

11. An assembly according to claim 10, including bottom inlet and outlet manifolds that are coaxial and in communication respectively with the inlet and outlet for the first fluid, and that are disposed beneath the subassembly, the bottom of the subassembly being defined by a frustoconical envelope converging from the cylindrical envelope, said frustoconical envelope surrounding the central manifold and co-operating therewith to define the annular manifold, the bottom manifolds being terminated upwards by flanges suitable for receiving the bottom free ends of the central manifold and of the frustoconical envelope in leaktight manner merely by mutual engagement.

12. An assembly according to claim 4, wherein the central manifold presents an inspection hole that is closed by a removable hatch, and that communicates with the inlet chamber, and the inspection channel presents an opening communicating with the outlet chamber.

13. An assembly according to claim 1, wherein the enclosure presents a bottom end wall, and wherein the assembly includes a circulation member fastened to the bottom end wall and suitable for sucking in the first fluid coming from the annular channel or from the central channel and of delivering it to the outlet for the first fluid.

14. An assembly according to claim 1, wherein the axial inlet and outlet manifolds, the central manifold, and the annular manifold, all have through sections that are sufficient to enable an operator to act directly on the heat exchangers.

15. An assembly according to claim 1, wherein the inlet and the outlet for the first fluid are coaxial.

16. An assembly according to claim 1, wherein the heat exchangers are disposed regularly spaced apart in a circle around the central axis, each axial manifold being defined both inwards and outwards by respective inner and outer circumferential sheets welded to the two heat exchangers between which said manifolds extend.

17. An assembly according to claim 16, wherein the annular manifold is defined inwardly by the heat exchangers and by the outer sheets.

18. An assembly according to claim 16, wherein the central manifold is defined by the heat exchangers and by the inner sheets.

19. An assembly according to claim 16, wherein each heat exchanger comprises a plurality of heat exchange modules that are stacked axially.

20. An assembly according to claim 16, wherein the modules present, perpendicularly to the central axis, a section that is rectangular, and present corners that are machined over the full axial height of the heat exchanger, the heat exchanger further including forged and/or machined metal bars disposed in the machined corners and onto which the modules are welded.

21. An assembly according to claim 20, wherein each bar presents a flange projecting circumferentially relative to the modules and towards the neighboring axial manifold, having the inner or outer sheet defining said axial manifold welded thereto.

22. The use of an assembly according to claim 1 for a first fluid mainly comprising helium and a second fluid mainly comprising helium and/or nitrogen.

23. The use of the assembly according to claim 1, with a first fluid mainly comprising helium and a second fluid mainly comprising water, the second fluid being vaporized in the heat exchanger assembly.

24. The use of an assembly according to claim 1, with first and second fluids mainly comprising water, the second fluid being vaporized in the heat exchanger assembly.

25. The use according to claim 22, wherein one of the first and second fluids comes from a nuclear reactor.

* * * * *